US006257632B1

(12) United States Patent
Jung et al.

(10) Patent No.: US 6,257,632 B1
(45) Date of Patent: Jul. 10, 2001

(54) KEY COLLAR FOR A MOTOR VEHICLE DOOR LOCK OR THE LIKE AND MOTOR VEHICLE DOOR LOCK WITH THIS KEY COLLAR

(75) Inventors: Oliver Jung, Wuppertal; Siegfried Reichmann, Wermelskirchen; Bernd Allefeld, Breckerfeld; Bernd Weyerstall, Wuppertal; Berthold Huessler, Ahaus; Bernd Huster, Muenchberg; Hansjuergen Linde, Coburg; Uwe Neumann, Bamberg; Heinrich Plett, Wermelskirchen; Stefan Schwitters, Remscheid, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/494,663

(22) Filed: Jan. 31, 2000

Related U.S. Application Data

(62) Division of application No. 09/147,580, filed as application No. PCT/DE97/01256 on Jun. 19, 1997.

(30) Foreign Application Priority Data

Jul. 26, 1996 (DE) ..... 196 30 245

(51) Int. Cl.[7] ..... E05B 15/02
(52) U.S. Cl. ..... 292/341.18; 292/341.15
(58) Field of Search ..... 292/341.17, 341.18, 292/341.15, 340, DIG. 55, 341.12, 341.13

(56) References Cited

U.S. PATENT DOCUMENTS

| | | | | |
|---|---|---|---|---|
| 446,173 | * | 2/1891 | Hancock | 292/341.19 |
| 513,667 | * | 1/1894 | Buckingham | 292/341.18 |
| 702,605 | * | 6/1902 | Voight | 292/281 |
| 2,113,121 | | 4/1938 | Peterson | 292/341.15 |
| 2,681,245 | * | 6/1954 | Ackermans | 292/341.19 |
| 3,415,559 | | 12/1968 | Jeavons | 292/216 |
| 3,561,792 | * | 2/1971 | Cycowicz | 287/101 |
| 3,727,960 | * | 4/1973 | Uemura | 292/216 |
| 4,225,166 | * | 9/1980 | Tanaka | 292/341.17 |
| 4,323,271 | * | 4/1982 | Tamiguchi | 292/341.18 |
| 4,613,176 | | 9/1986 | Kelly | 292/201 |
| 5,273,325 | | 12/1993 | Zimmerman | 292/216 |
| 5,529,356 | * | 6/1996 | Cetnar | 292/340 |
| 5,707,092 | * | 1/1998 | Van Slembrouck | 292/341.19 |

* cited by examiner

*Primary Examiner*—Gary W. Estremsky
(74) *Attorney, Agent, or Firm*—Nixon Peabody LLP; David S. Safran

(57) ABSTRACT

The subject of the invention is a key collar for a motor vehicle door lock or the like including a key collar support plate fixedly attached on a support sheet, and a collar element supported on the collar support plate which, in operation, engages a lock catch of the motor vehicle door lock or the like. Optionally, the key collar includes an elastomer arrangement which allows the collar element to move a limited distance relative to the collar support plate in the plane of the collar support plate thereby better meeting the different requirements of normal use conditions and during a vehicle crash. In operation, the collar element of a preferred embodiment is supported on the collar support plate on two spaced bearing points, one bearing point with a trailing bridge in a manner that collar element can be swivelled around an axis which is perpendicular to collar support plate, and another bearing point with a leading bridge which can be displaced in corresponding arc-shaped crank.

8 Claims, 4 Drawing Sheets

KEY COLLAR FOR A MOTOR VEHICLE DOOR LOCK OR THE LIKE AND MOTOR VEHICLE DOOR LOCK WITH THIS KEY COLLAR

This application is a Divisional application of Ser. No. 09/147,580, filed Jan. 26, 1999; which is a 371 of PCT/DE97/01256, filed Jun. 19, 1997.

BACKGROUND OF THE INVENTION

1. Field of the Invention

The invention relates to a motor vehicle door lock including a key collar support plate fixedly attached on a support sheet, and a collar element supported on the collar support plate where, in operation, the collar element engages a lock catch of the motor vehicle door lock. More specifically, the invention relates to such key collars with an elastomer arrangement which allows the collar element to move a limited distance relative to the collar support plate in the plane of the collar support plate. In addition, the present invention also relates to motor vehicle door locks including such a key collar, a lock catch where the lock catch includes an opening that swivels around an axis to receive a leading bridge of a key collar and also includes a detent pawl which fixes the lock catch in the closed position.

2. Description of Related Art

Motor vehicle door locks are generally based on several, conventionally known designs. A key collar of a motor vehicle door lock is generally mounted on a door post or a part of the frame (for example, the B column or the C column). Usually, the key collar is mounted using mounting screws which are inserted through insertion openings provided in the side flanges of the key collar and screwed into threaded openings in the door posts. The lock housing of these motor vehicle door locks which house the various components of the door lock, may be made from one or two parts and is mounted in a similar manner using mounting screws on the corresponding body part which is generally the front plate of a motor vehicle door. For a long time, it has been assumed in the art that it is important to keep the relative positions between the key collar and lock housing constant as much as possible in order to ensure that there is always an accurately determined relative engagement position of the two parts of the motor vehicle door lock.

In key collar and motor vehicle door lock designs on which the present invention is based (German Utility Model DE-U-88 06 819), the comfort requirements of the motor vehicle user with regard to noise abatement have become important. In accordance with the prior art, the flanges of the collar element which project laterally are inserted into an elastomer arrangement in a trough-shaped collar support plate so that there is no direct contact bridge for solid-borne noise between the collar element and the collar support plate. The collar support plate itself is attached, as explained previously, to the mounting sheet with mounting screws. This embedding of the collar element in the elastomer arrangement necessarily results in allowing a limited amount of movement by the collar elements. Therefore, the collar elements may move a little to the top or bottom, to the front or back, depending on the compliance of the elastomer arrangement. This is not inherently desirable, but in view of the small deflection of less than +/−1 mm, the movement can be regarded as an acceptable compromise.

In addition, prior art key collars for motor vehicle door locks including a key support plate with a permanently deformable section is also known (German Patent DE-C-30 26 147). In this design, the collar element more or less adjusts itself in the installation of the motor vehicle door and then, may be fixedly mounted in the adjusted position by tightening the mounting screws on the support sheet. This is, of course, a much easier installation of the key collar than the prior conventional installation and readjustment designs which required repeated loosening and retightening of mounting screws (published German Patent Application DE-A-29 36 997).

A conventional lock structure with a rotary catch including a fork catch and tensile stressed detent pawl is also disclosed in the above explained prior art. The structure shown is considered to be the standard for conventional motor vehicle door locks and the prior art shows a key collar (ie. a locking pin) located far above the swivel axis of the lock catch with only one bridge in the lock latch when the lock latch is in its closed position. This has the known effect of transferring the shearing forces during a crash through a relatively large lever arm engaging the rotary catch. Consequently, the rotary catch must be over designed and made relatively massive to increase its strength.

In addition, making a rotary catch as a disk of solid material instead of a fork catch is also known in the prior art (German Patent DE-C-16 78 121). In such designs, the rotary catch is pivotally mounted in a recess with a peripheral surface abutting the rotary catch. As a result, there is no bearing pin in the middle of the rotary catch and the swivel axis of the rotary catch is only virtual. The rotary catch is fixed axially by the bottom surface of the recess and by a cover that includes an impression in the area of the center point of the rotary catch on the cover which limits the sliding friction between the rotary catch and the cover.

Generally in the prior art, a key collar used in the motor vehicle door lock is designed to withstand large forces during a vehicle crash. This entails over dimensioning of the components and do not provide the optimum configuration for normal, everyday operation.

SUMMARY OF THE INVENTION

Therefore, a primary object of the present invention is to provide a key collar, and in a corresponding manner a motor vehicle door lock with this key collar, that better meets the differing requirements of operation during normal use and during a vehicle crash.

The aforementioned object is achieved in a key collar for a motor vehicle door lock including a key collar support plate fixedly attached on a support sheet, and a collar element supported on the collar support plate where, in operation, the collar element engages a lock catch of the vehicle door lock. The key collars include an elastomer arrangement which allows the collar element to move a limited distance relative to the collar support plate in the plane of the collar support plate. The movement is resisted by a frictional force and the collar element remains in the displaced position relative to the collar support plate without any additional force. In addition, the present invention also provides motor vehicle door locks with such a key collar, a lock catch where the lock catch includes an opening that swivels around an axis to receive a leading bridge of a key collar, and a detent pawl which fixes the lock catch in the closed position.

In the present invention, the known prior art float bearing of the collar element is used in an elastomer arrangement to specifically support the collar element relative to the collar support plate. This allows a certain degree of relative displacement and thus, always allows automatic alignment of the location of the key collar relative to the location of the lock catch in the motor vehicle door lock as the motor vehicle door is closed. The movement which was accepted as tolerance in the prior art, is specifically designed and used within wider limits in the present invention, thereby eliminating the adjustment and readjustment of the key collar during mounting. Currently, the motor vehicle doors are generally fitted very exactly due to the small body gap requirements. In this embodiment, the maximum displacement allowable during operation of the vehicle door is limited to +/−3 to 6 mm and preferably, is +/−4.5 mm.

Although the prior art discloses key collars that can be moved or swivelled in a straight line, or optionally, can be moved with a cam disk in order to aid in the locking function, these designs differ from the present intention in that in these designs, the vehicle door is pulled tightly into its final closed position by the corresponding displacement of the key collar and not by moving the rotary catch. Therefore, this type of movement of the key collar is not related to the collar displacement of the present invention, but rather performs an entirely different function. In particular, the collar is moved in order to close the vehicle's door and does not serve to ensure an accurate relative positioning of the key collar and lock catch.

In another embodiment of the present invention, the key collar acquires an additional degree of freedom by the collar element being able to swivel, to a limited degree, around the trailing bridge so that the leading bridge can execute arc-shaped, up and down motion when the lock catch enters the receiving opening. In this way the leading bridge can be swivelled around the swivel axis of the lock catch when the motor vehicle door is closed.

When the lock catch reaches its closed position, the lock catch is fixed by the detent pawl. There is a minimum lever arm relative to the swivel axis of the lock catch which allows the operation of the lock catch. The present embodiment as applied to motor vehicle door locks is especially significant in that in the closed position, the swivel axis of the lock catch lies directly on the connecting line of the two bridges of the collar element of the key collar.

With a key collar in accordance with the present invention, numerous advantages are achieved over the prior art. The dimensions of the lock catch can be reduced and the axial distance between the detent pawl and the lock catch can also be reduced thereby reducing the construction size of the motor vehicle door lock overall. The direction in which the opening and shearing forces act with the door closed proceeds with the minimum possible lateral distance from the real or virtual swivel axis of the lock catch so that the shearing forces can be optimally routed into the receiver. As a result, the lock catch is made simpler, and possibly other materials can even be used in the design. At the minimum, the lock catch may be made much thinner with the same resistance to shearing forces during a crash as conventionally designed lock catches.

In the above described embodiment of the key collar including a swivel axis of the lock catch lying directly on the connecting line of the two bridges of the collar element of the key collar, the disc-shaped lock catch known in the art becomes especially suitable. The arc distance between the forward stop and the main stop on the outer periphery of the lock catch is much larger than in the prior art with classical fork catches in which the engagement point remains at a distance from the swivel axis.

For the sake of completeness it should be pointed out here that the key collar can also have the form of a locking pin which has only one bridge. What was explained above regarding the connecting line of the two bridges of the collar element of the key collar relative to the swivel axis of the lock catch can be modified in this case by the locking pin, in the closed position, lying only slightly near the line of action of the shearing forces which occur in operation, said line crossing the swivel axis.

The teaching of the invention is presented in the context of motor vehicle door locks. However, in a corresponding manner, the present invention may also be effectively applied to motor vehicle hood locks, tailgate locks, etc., and the motor vehicle door lock discussion below should always be understood in the comprehensive sense to apply to the other applications noted.

In the following the invention is explained in greater detail using drawings which show, as an example only, three embodiments of the invention.

DETAILED DESCRIPTION OF THE INVENTION

Figure 1:
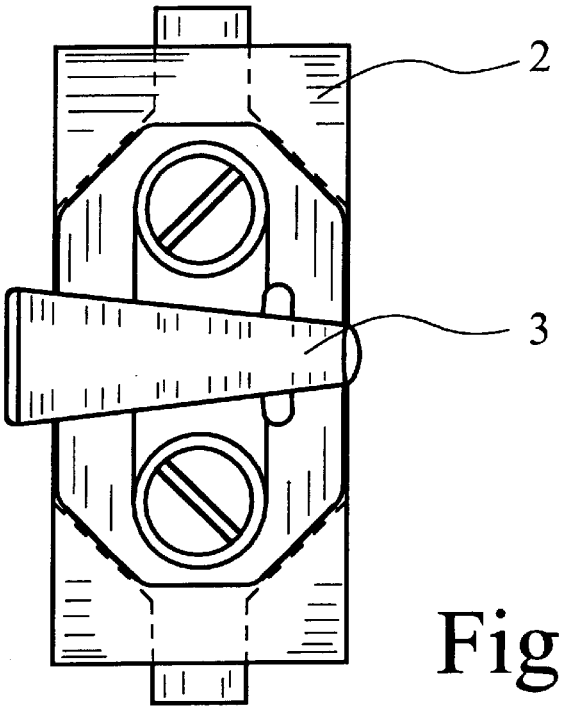
FIG. 1 is an elevation view a first embodiment of a key collar in accordance with the invention.
Figure 2:
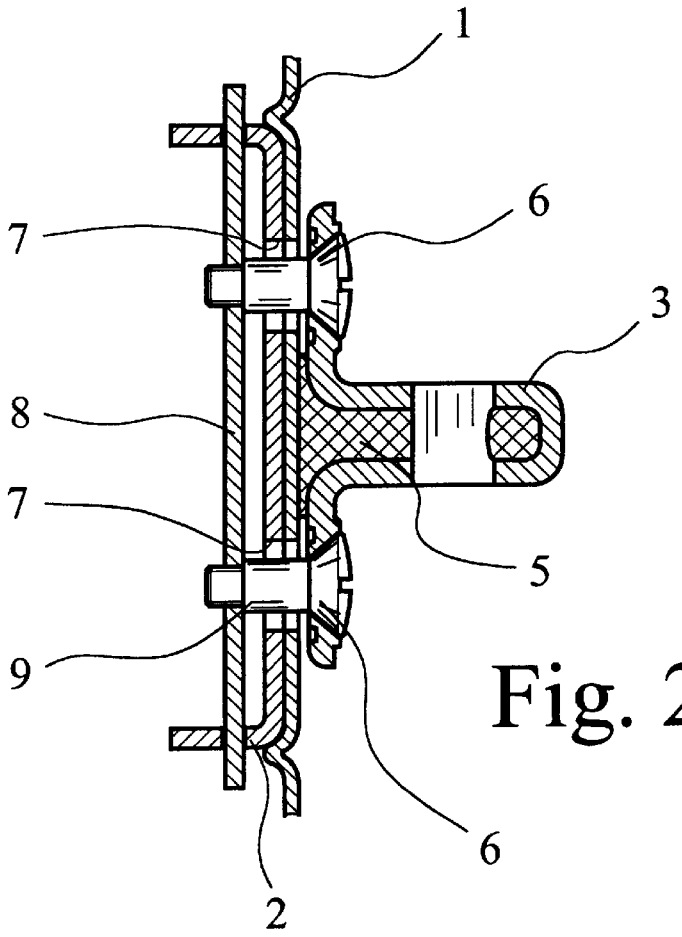
FIG. 2 shows the key collar of FIG. 1 in a section taken along a transverse center axis.

In the following, the present invention is described using the example of a motor vehicle door lock. As noted previously, however, the present invention can also be applied to other locks including hood locks, gate locks and tailgate locks on motor vehicles. The key collar shown in FIGS. 1 and 2 is intended and suited for use in a motor vehicle lock or the like. The general concepts related to motor vehicle door locks and key collars have been discussed previously in the above sections. In principle, the teaching of this patent application can also be applied to key collars with only one bridge which is also known as a locking pin. Therefore, this one bridge design incorporating the present features should also be considered an embodiment of the present invention discussed below.

Figure 6:
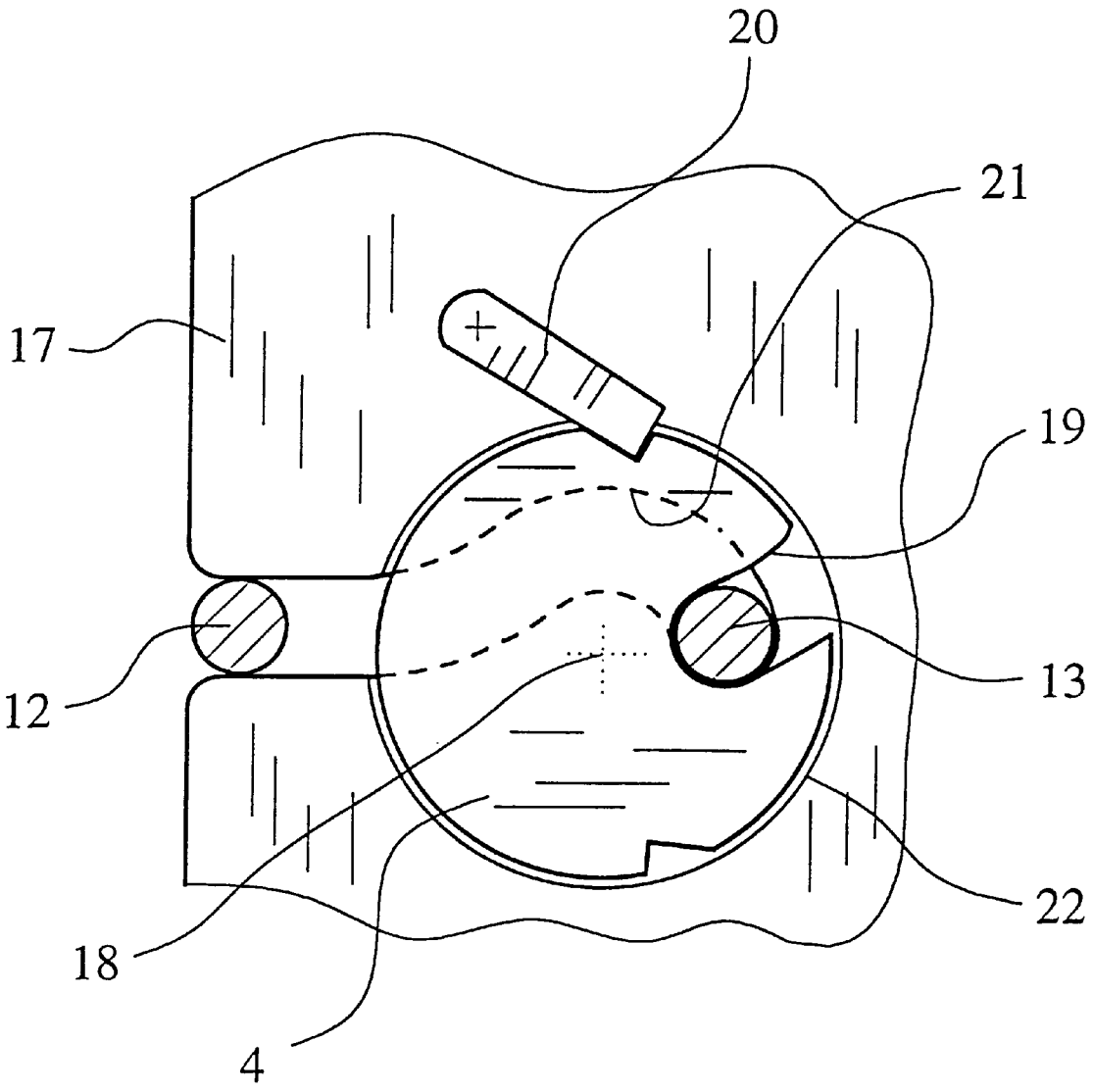
FIG. 6 shows the interaction of the key collar shown in FIGS. 4 & 5 with a lock catch.

The key collar, first of all, has a collar support plate 2 to be fixed on a support sheet 1, which is shown by the broken line of FIG. 2, and a collar element 3 supported on the collar support plate 2. In operation, the collar element engages a lock catch 4 of the motor vehicle door lock as shown in FIG. 6. An elastomer arrangement 5 is shown in collar element 3 and conforming to support sheet 1.

Here, it is shown that collar element 3 is supported to allow certain amount of displacement relative to the collar support plate 2 in the installed state. This is made especially clear by FIG. 2 which shows mounting screws 6 which penetrate longitudinal holes 7 in collar support plate 2.

The embodiment shown in FIG. 2 includes a collar element 3 being attached to a retaining plate 8 so that, between the collar element 3 and the retaining plate 8, there is a predetermined and defined distance. In the embodiment shown, this distance is defined by spacer collars 9 on mounting screws 6. In the installed configuration, the support sheet 1 is located between the retaining plate 8 and the collar element 3. It can be seen that the retaining plate 8 is supported to allow displacement relative to the collar support plate 2. In fact, as a result of longitudinal holes 7, the unit consisting of collar element 3 and retaining plate 8 can be shifted up or down relative to collar support plate 2. This shifting is resisted by the frictional contact and the spring action of the elastomer arrangement 5 on support sheet 1. Therefore, in this embodiment, when the motor vehicle door is closed for the first time, the collar element 3 moves together with the retaining plate 8 up or down relative to collar support plate 2 such that an optimum fit is achieved. Thus, with the present invention, adjustment and readjustment of the key collar is no longer necessary.

Figure 3:
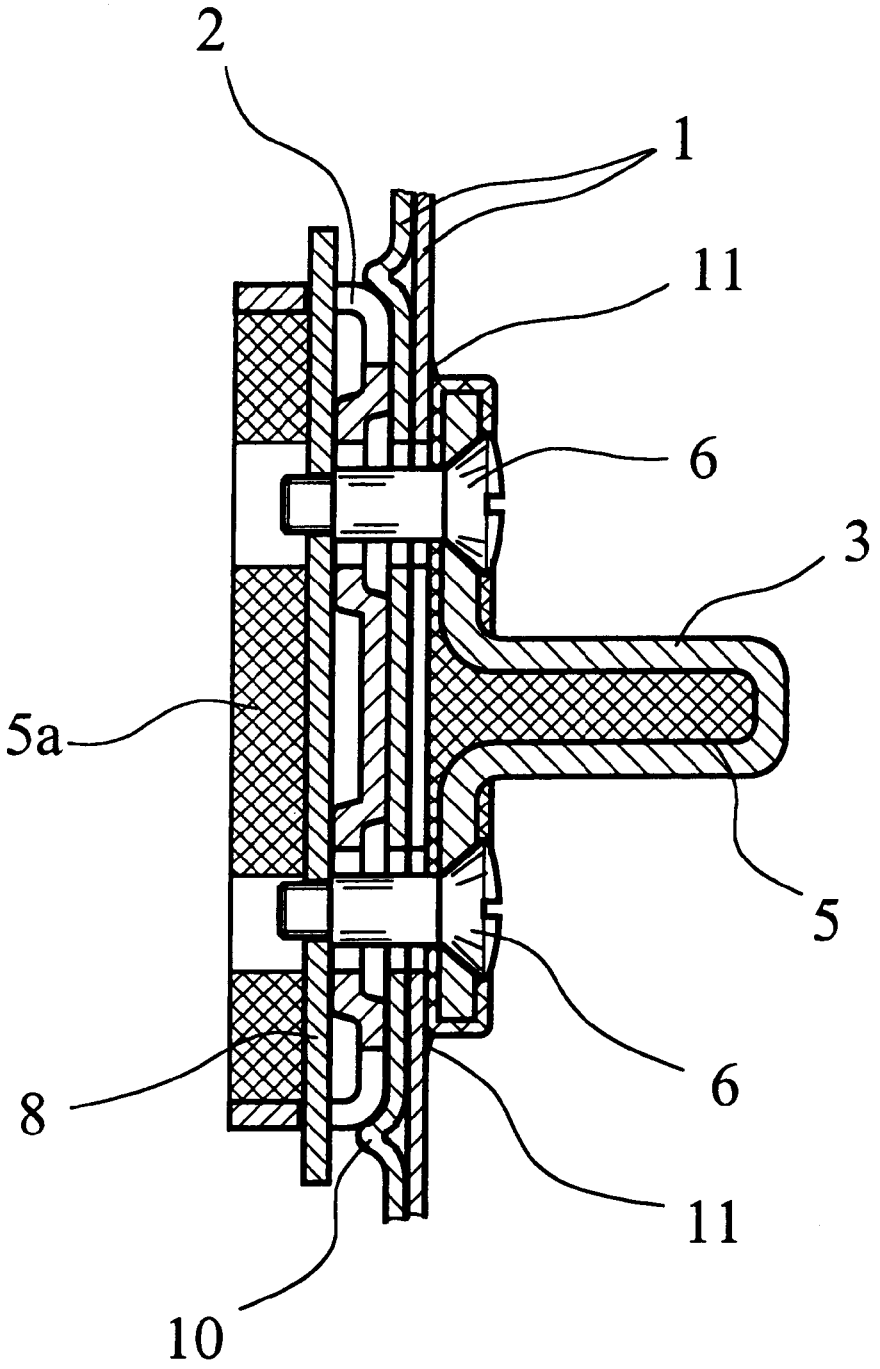
FIG. 3 shows a view corresponding to that of FIG. 2, but of another embodiment of a key collar in accordance with the invention.

As an example, the embodiments in FIGS. 1 and 2, on the one hand, and FIG. 3, on the other, may allow a deflection of +/−3 to 6 mm, which is the maximum deflection allowable during use. In this embodiment, the deflection is preferably +/−4.5 mm relative to the neutral or middle position, which is shown in FIGS. 1 and 3.

FIG. 3 illustrates another embodiment of the present invention, clarifying the installation position of the key collar of FIG. 1. The collar support plate 2, such as the one shown in FIG. 1, comes to rest between retaining plate 8 and collar element 3. In both embodiments, the collar support plate 2 is made in the manner of a trough or a cage and the retaining plate 8 is supported to move therein against the friction force exerted by the spring action from the elastomer arrangement 5. In this way, the key collar of the present invention is adjusted into its intended position when the motor vehicle door is closed for the first time and is retained in the position during operation as a result of frictional force.

In the embodiment shown in FIG. 3, a second elastomer arrangement 5*a* (or spring element) is positioned in the receiver of collar support plate 2. In this embodiment, the frictional force occurs between retaining plate 8 and collar support plate 2. In addition, as shown in the figure, the collar support plate 2 on support sheet 1 is fixed between beads 10 which prevent its displacement to the top and bottom.

FIG. 3 also shows that the collar element 3 is provided with projections 11 on the side facing collar support plate 2 at the outside edge that provide tolerance compensation. In the embodiment shown, the projections 11 are formed by extrusion molding of collar element 3 with injectable plastic.

Figure 4:
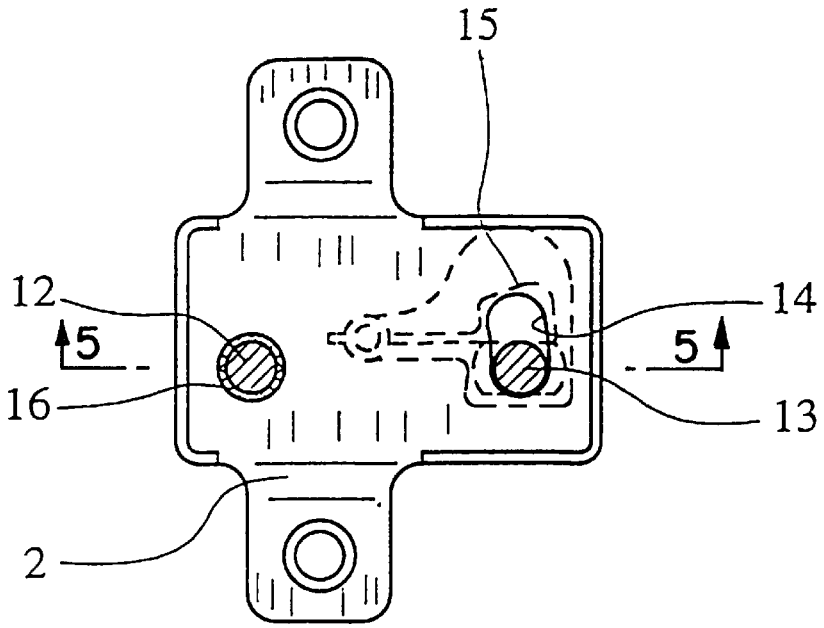
FIG. 4 shows a third embodiment of a key collar in accordance with the invention which includes a dynamized key collar.
Figure 5:
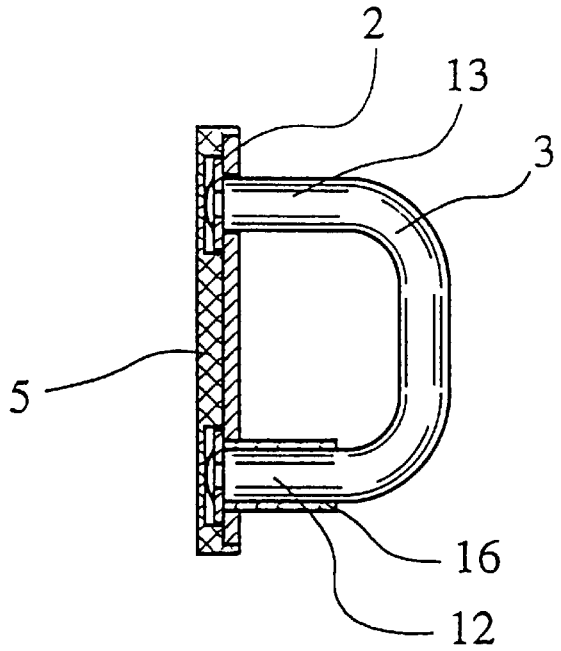
FIG. 5 is a partial sectional view of the key collar of FIG. 4, the collar support plate being sectioned along line 5—5 in FIG. 4.

Another embodiment of a key collar in accordance with the present invention and its operation is shown in FIGS. 4, 5 and 6 which also illustrate the collaboration of the key collar with a lock catch 4. This will now be explained with reference to the combination of all three drawings. More specifically, the collar element 3 is supported on collar support plate 2 on two spaced bearing points so that, at one bearing point with trailing bridge 12, the collar element can pivot around an axis which is perpendicular to collar support plate 2, and at the other bearing point with leading bridge 13, the collar element can be displaced in a corresponding arc-shaped crank 14. Thus, a floating collar element 3 is provided where the leading bridge 13 can deflect upwards within the arc-shaped crank 14 as shown in FIG. 4. In this embodiment and according to the preferred teaching, the leading bridge 13 is engaged by a spring 15 which always returns the leading bridge 13 to its neutral position. The spring 15 may be made from a bendable plastic. FIG. 5 further illustrates that collar element 3, in the preferred embodiment shown here, may be easily made as a clip. According to the preferred teaching, on following bridge 12, a bearing sleeve 16 is provided for swivel support of the collar element FIG. 5 shows elastomer arrangement 5, which is inserted on the rear side and which has no additional function in the present embodiment.

It can be assumed that features of the embodiment of the key collar as shown in FIG. 1 or FIG. 3 and the features of the embodiment as shown in FIGS. 4 and 5 can be combined to provide a key collar which is supported to float and which is also self adjusting. In such an embodiment, the elastomer arrangement 5 in FIG. 5 would also acquire an additional function in that it would then provide the frictional forces on the support sheet 1 as described previously.

FIG. 6 illustrates the key collar as shown in FIG. 4 in operation and collaborating with a lock catch 4 in the motor vehicle lock. In this figure, the housing 17 is shown with the lock catch 4 supported therein so as to swivel around a real swivel axis 18. The lock catch 4 includes an opening 19 for receiving the leading bridge 13 of the key collar. The figure also shows a detent pawl 20 which fixes the lock catch 4 in the closed position and can also be used in conjunction with the embodiments of the key collars discussed and illustrated previously. FIG. 6 also shows the lock catch 4, which is disk-shaped. The disc-shaped lock catch 4, which is known in the prior art, is pivotally mounted in a recess 22 as indicated. As is apparent to those skilled in the art, this invention car also be easily used in conventional fork catch designs with a virtual swivel axis.

The embodiment shown illustrates the special advantage of a disc-shaped lock catch 4 in the implementation of the teachings of this invention. The leading bridge 13 of the key collar traverses a relatively wide path between the entry point (not shown) at the receiving opening 19 to the closed or blocked position shown in FIG. 6 where the detent pawl 20 is at the main stop of rotary catch 4. In this regard, FIG. 6 illustrates that the housing 17 includes an inlet slot 21 for receiving the collar element 3 of the key collar which runs in an arc shape around the swivel axis 18 of lock catch 4. The arc shape of inlet slot 21 smoothly corresponds to the path of the leading bridge 13 of the key collar in the receiving opening 19 of the rotary catch 4. The location of the main stop and the forward stop on rotary catch 4 illustrates that, when made as a fork catch, there would have to be a very wide fork catch legs that takes into account this displacement. Accordingly, the main stop and the forward stop can be produced more easily and feasiblely with disc-shaped lock catch 4 of the embodiment shown.

It is important to note that, due to the above explained operation of the key collar in lock catch 4 so as to be fixed in the closed position, the swivel axis 18 of lock catch 4 lies directly on the connecting line of the two bridges 12 and 13 of collar element 3. This has the advantages explained above in the general part of the description which need not be repeated here. FIG. 6 shows clearly that the proximity of swivel axis 18 to the connecting line leads to application of the shearing forces, for the most part, directly to swivel axis 18. The remaining minor offset is a sufficient lever arm to provide the force necessary to allow the lock catch 4 to be opened.

We claim:

1. Key collar for a motor vehicle door lock comprising a collar support plate which is attached to a support sheet and a collar element supported on said collar support plate in a manner permitting relative displacement therebetween in a plane of said collar support plate, said collar element being engageable, in use, with a lock catch of a motor vehicle door lock;

wherein said collar element is displaceable relative to said collar support plate by a predetermined distance in a plane of said collar support plate against a friction force which acts in a plane perpendicular to the surface of the collar plate said collar element maintaining a displaced position relative to said collar support plate without an additional action of force;

wherein said friction force results from a spring action force which acts perpendicular to the plane of said surface of the collar support plate, said spring action force being produced by an elastomer arrangement positioned into said key collar, said elastomer arrangement having a contact face that lies in a plane parallel to said surface of the collar support plate to thereby produce said friction force.

2. Key collar as claimed in claim 1, wherein said elastomer arrangement is a form-filling part positioned to be received inside of said collar element and to form said contact surface adjacent to a surface of the collar support plate to thereby produce said friction force.

3. Key collar as claimed in claim 2, wherein said collar element is permanently attached to a retaining plate with a predetermined distance therebetween, said support sheet and said collar support plate being positioned between said retaining plate and said collar element when said key collar is installed, and said retaining plate being supported displaceably relative to said collar support plate; wherein a second elastomer arrangement is located in a receiver portion of said collar support plate, said second elastomer arrangement having a contact surface which abuts a surface of said retaining plate to thereby produce a friction force between said retaining plate and said collar support plate.

4. Key collar as claimed in claim 1, wherein said predetermined distance is ±3 to 6 mm from a neutral position.

5. Key collar as claimed in claim 4, wherein said predetermined distance is substantially ±4.5 mm from a neutral position.

6. Key collar as claimed in claim 1, wherein said collar element is permanently attached to a retaining plate with a predetermined distance therebetween, said support sheet and said collar support plate being located between said retaining plate and said collar element when said key collar is installed, and said retaining plate being supported to be displaceable relative to said collar support plate.

7. Key collar as claimed in claim 6, wherein said collar support plate has a trough-shape and a receiver portion, and wherein said retaining plate is supported to move within the trough-shape of the collar support plate.

8. Key collar as claimed in claim 7, wherein said elastomer arrangement is positioned into said receiver portion of said collar support plate to form said contact surface which lies adjacent to a surface of the collar support plate to thereby produce said friction force.

* * * * *